US005536011A

United States Patent [19]

Gutowski

[11] Patent Number: 5,536,011

[45] Date of Patent: Jul. 16, 1996

[54] PERIMETER-WEIGHTED GOLF CLUB IRON AND METHOD FOR MAKING SAME

[76] Inventor: Thaddeus Gutowski, 424 Oak Run Ct., Royal Oak, Mich. 48073

[21] Appl. No.: 263,052

[22] Filed: Jun. 21, 1994

[51] Int. Cl.[6] ..... A63B 53/04

[52] U.S. Cl. ..... 473/350; 473/345

[58] Field of Search ..... 273/167 R, 77 R, 273/77 A, 167 H, 167 F, 169, 173, 193 R, 194 R, 194 B, 162 R

[56] References Cited

U.S. PATENT DOCUMENTS

| | | | |
|---|---|---|---|
| D. 318,087 | 7/1991 | Helmstetter | D21/214 |
| D. 321,920 | 11/1991 | Parente et al. | D21/220 |
| D. 322,651 | 12/1991 | Parente et al. | D21/220 |
| D. 322,652 | 12/1991 | Antonious | D21/220 |
| 3,652,093 | 3/1972 | Reuter, Jr. | 273/169 |
| 4,749,197 | 6/1988 | Orlowski | 273/167 H |
| 4,792,140 | 12/1988 | Yamaguchi | 273/173 |
| 4,836,550 | 6/1989 | Kobayashi | 273/167 H |
| 4,984,800 | 1/1991 | Hamada | 273/173 |
| 4,995,609 | 2/1991 | Parente et al. | 273/80.2 |
| 4,995,612 | 2/1991 | Finney | 273/169 |
| 5,028,049 | 7/1991 | McKeighen | 273/167 H |
| 5,042,806 | 8/1991 | Helmstetter | 273/80.2 |
| 5,067,711 | 11/1991 | Parente et al. | 273/77 A |
| 5,067,715 | 11/1991 | Schmidt et al. | 273/167 F |
| 5,163,682 | 11/1992 | Schmidt et al. | 273/167 J |
| 5,165,688 | 11/1992 | Schmidt et al. | 273/80 B |
| 5,180,166 | 1/1993 | Schmidt et al. | 273/167 F |
| 5,184,823 | 2/1993 | Desbiolles | 273/167 H |
| 5,204,046 | 8/1993 | Schmidt et al. | 264/328.1 |
| 5,222,734 | 6/1993 | Parente et al. | 273/80.2 |
| 5,240,252 | 8/1993 | Schmidt et al. | 273/167 A |
| 5,242,167 | 9/1993 | Antonious | 273/167 F |
| 5,255,918 | 10/1993 | Anderson | 273/167 H |
| 5,261,664 | 11/1993 | Anderson | 273/167 H |
| 5,282,624 | 2/1994 | Viste | 273/167 H |
| 5,297,803 | 3/1994 | Solheim | 273/77 A |
| 5,301,945 | 4/1994 | Schmidt et al. | 273/167 A |
| 5,301,946 | 4/1994 | Schmidt et al. | 273/169 |

FOREIGN PATENT DOCUMENTS

| | | | |
|---|---|---|---|
| 379032 | 8/1932 | United Kingdom | 273/78 |
| 2251556 | 7/1992 | United Kingdom | 273/167 R |

*Primary Examiner*—Sebastiano Passaniti
*Attorney, Agent, or Firm*—Weintraub, DuRoss & Brady

[57] ABSTRACT

A golf club head achieves perimeter weighting by forming a cavity in the back of the club head. The formation of the cavity allows for the extension of the backing of the club while maintaining the weight balance of the club. The club achieves an increase in size of the "sweet spot" due to this method of weight balancing.

11 Claims, 2 Drawing Sheets

FIG 1
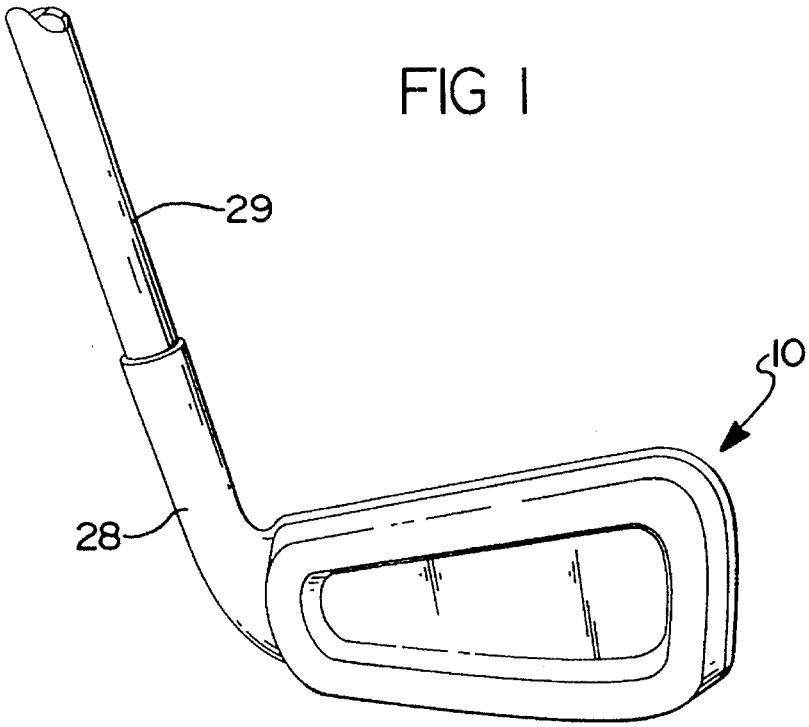
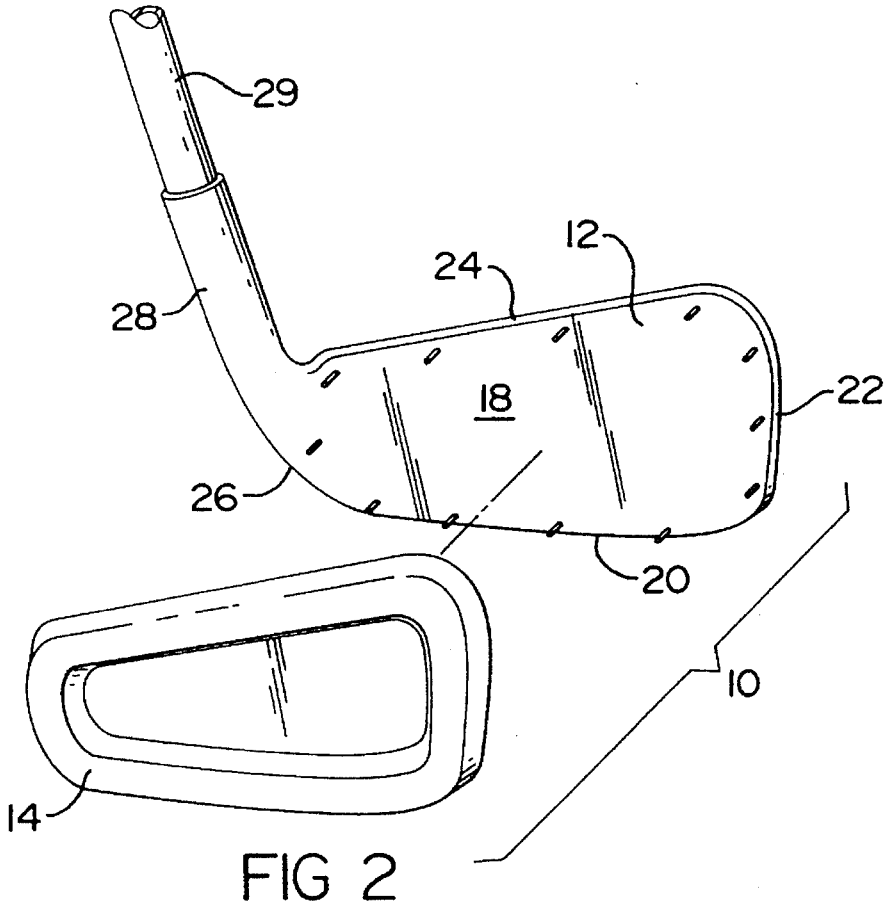
FIG 2

FIG 3
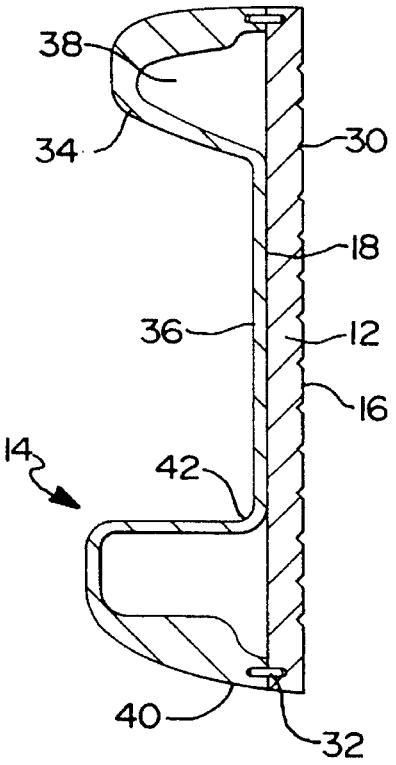
FIG 4
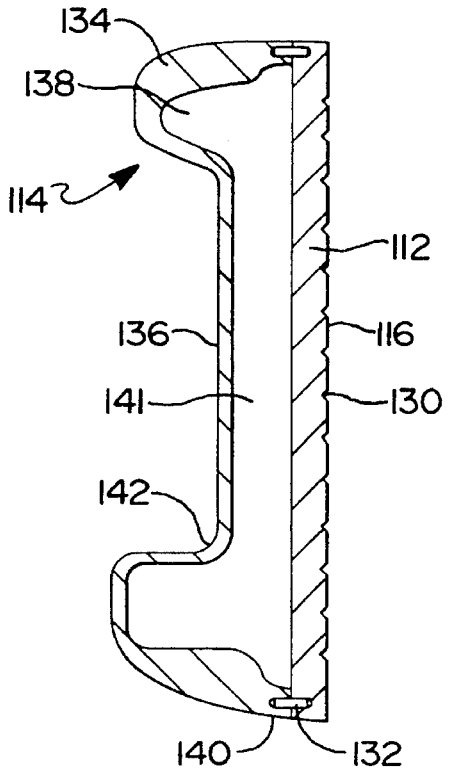
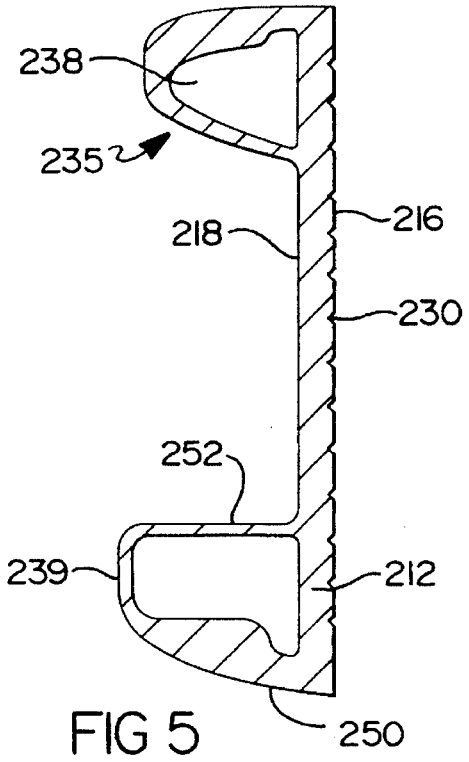
FIG 5

PERIMETER-WEIGHTED GOLF CLUB IRON AND METHOD FOR MAKING SAME

BACKGROUND OF THE INVENTION

1. Field of the Invention

The present invention concerns golf clubs, and specifically, those clubs termed "irons". More particularly, the present invention concerns perimeter-weighted golf irons. Even more particularly, the present invention concerns perimeter-weighted golf irons having a hollow portion formed within the back of the club head.

2. Description of the Prior Art

The construction and formation of golf clubs and, more particularly, the heads of the golf clubs, has been practiced and refined for decades. It has been known for quite some time that the angulation of the face of the club head will cause the ball to move at different trajectories. Thus, increased angulation is used for clubs in which the ball is only intended to be driven a short distance and/or at a high trajectory. Likewise, clubs in which a hit for greater distance is desired have a lesser angulation. The refinement of this knowledge was completed some time ago.

More recently, attention has been concentrated upon the weighting of the club head. It has been found that the club head for each particular iron must be within certain weight parameters for the maximum effectiveness of the club to be achieved. This knowledge also has been developed over time and through much experimentation and practice. Additionally, it has been the focus of golf club manufacturers to achieve weight balance in the club. This is so as to achieve a most fluid swing of the club head through the ball. By the balancing of the weight in the head, it is desired to achieve a full and flush hit of the golf ball. More specifically, it has become known that there exists a maximum effectiveness point on the club face for striking the ball in order to achieve the greatest result therefrom. This maximum point has been commonly referred to as the "sweet spot".

Thus, it has been a driving goal of the golf club manufacturing industry, in the present times, to attempt to enlarge the "sweet spot" on the face of a club head. By increasing this area on the club face from a mere point to a more defined and expanded region, perhaps as much as an inch in circumference, players may greatly increase their likelihood of making an optimum shot on any stroke. This will result in enhanced performances and in lower scores. Thus, the players will receive heightened enjoyment from their golf game and will steadily improve as players.

One known attempt to achieve an increase in the "sweet spot" of the club has been through the use of perimeter weighting. One example of this type of club head is found in U.S. Pat. No. 5,242,167 issued Sep. 7, 1993 to Antonius and is entitled "PERIMETER WEIGHTED IRON TYPE GOLF CLUB HEAD WITH CENTRALLY LOCATED GEOMETRICALLY SHAPED WEIGHT". Antonius teaches the concept of locating a peripheral mass, indicated at element 22, around the perimeter of the club head and, particularly, around the back thereof. As is commonly known, this forms a cavity within the perimeter. This method of club head construction achieves the goal of maintaining the weight of the club head within the known and optimum parameters, while balancing the weight within the club. It is by this balancing of weight around the perimeter that the area of the "sweet spot" is increased.

Another attempt to address this same concern is found in U.S. Pat. No. 5,301,946 which issued Apr. 12, 1994 to Schmidt et alia and is entitled "IRON GOLF CLUB HEAD WITH DUAL INTERSECTING RECESSES AND ASSOCIATED SLITS". Schmidt et alia teaches the formation of a weighted perimeter around the back of the club head. Schmidt et alia further teaches the formation of a slit or recess between the rear face of the club head and the weighted, extended perimeters. Schmidt et alia thus achieves another way for distributing perimeter weight in this type of golf club head.

However, it is believed that the area of the "sweet spot" can be additionally expanded and methods can be used to increase the size of the ridge attached to the perimeter proximate the rear of the golf head while yet maintaining the parameters of overall club head weight. Further, it is believed that by this increase in the size of the perimeter that twist resistance, that is, the resistance of the golfer to the twisting of the face of the golf club when striking through the ball, will be increased. It is to these goals that the present invention is directed.

SUMMARY OF THE INVENTION

The present invention is a golf club head comprising:

(a) a face member comprising a forward side and a rearward side, the forward side having a rearward angulation, the face member having a perimeter;

(b) a plurality of pins formed to the rearward side of the face;

(c) a backing mounted onto the pins and joined to the face, the backing comprising a circumferential ridge having an outer perimeter and an inner perimeter, the outer perimeter being substantially similar to the perimeter of the face, the ridge having a cavity formed therein; and (d) means for joining the backing to the club face.

The means for joining, in the preferred embodiment, comprises welding. Other means for joining, as are commonly known in the art, could be effected.

In a preferred embodiment, the backing may further comprise a planar member. The planar member is unitarily formed in the backing proximate the inner perimeter. The planar member may be formed such that, when the backing is attached to the face, the backing flushly contacts the rearward side of the face. Alternately, the planar member may be formed such that, when the backing is attached to the face, an interior is defined between the rear of the face and the planar member. The interior may be in fluid communication with the cavity formed in the ridge along the perimeter of the backing or, conversely, it could be separated therefrom. The present invention will be more clearly understood by the following detailed description, with reference being made to the accompanying drawings, in which like reference numerals refer to like parts, in which:

BRIEF DESCRIPTION OF THE DRAWINGS

FIG. 1 is a perspective view of a first embodiment of the perimeter weighted club head of the present invention;

FIG. 2 is an exploded view of the first embodiment of the present invention;

FIG. 3 is a side view of the first embodiment of the second invention;

FIG. 4 is a cross-sectional view of a second embodiment of the second invention; and FIG. 5 is a cross-sectional view of a third embodiment of the golf club head of the present invention;

DETAILED DESCRIPTION OF THE PREFERRED EMBODIMENTS

Referring now to FIGS. 1–3 of the drawings, there is shown a first embodiment of the present invention, to wit, a perimeter-weighted club head 10. The head 10 comprises a face 12 and a backing 14. The face 12 and the backing 14 are formed of a metallic alloy, such as stainless steel or a titanium alloy, or other alloy as is known in the art.

The face 12 has a forward side 16 and a rearward side 18. The face 12 further comprises a bottom 20, a toe 22, a top 24, and a heel 26. The configuration of the face 12 is such that it is generally trapezoidal; that is, the toe 22 is longer than the heel 26, thus causing the top 24 to be elevated, relative to the bottom 20, at the point where it meets the toe 22 than at the point at which it meets the heel 26. A hosel 28 is integrally formed to the face 12 proximate the heel 26. The hosel 28 receives the shaft 29 of the club, as is commonly known. The face 12 further has a plurality of grooves 30 formed on the forward side 16.

A plurality of pins 32 are integrally formed to the rearward side 18 of the face 12. The pins 32 are substantially cylindrical and extend approximately one-quarter inch rearwardly from the face 12. The pins 32 serve to mount the backing 14, as will be further discussed herein below.

The backing 14 comprises a ridge 34 and a planar member 36. The backing 14 has a general configuration substantially similar to that of the face 12 and, in particular, the rearward side 18 thereof. This defines an outer perimeter 40, to which the ridge 34 adheres and is formed around. The ridge 34 further defines an interior perimeter 42, the interior perimeter 42 being the intersection or joint of the ridge 34 and the planar member 36 in the first embodiment. The ridge 34 and planar member 36 are integrally formed, such that the backing 14 is a unitary member.

The ridge 34 has a cavity 38 formed therein. The cavity 38 is formed such that when the backing 14 is mounted to the face 12, the cavity 38 is entirely contained therebetween, with no communication possible with the environment surrounding the club head 10. The purpose of forming the cavity 38 in the ridge 34 is to achieve a greater height or length of the ridge 34.

As previously stated hereinabove with regard to the prior art, it is known to create a raised perimeter on the head 10 of a golf club and, particularly, in reference to those clubs termed "irons". It is also known that the weight of the club head 10 must be maintained within well known parameters. Therefore, the size of the ridge 34 has been heretofore limited. By the formation of the cavity 38 in the ridge 34, the present invention of the club head 10 achieves a greater height or length than heretofore known in the art. This gives the advantage of allowing for greater balance and increased twist resistance of the club head 10 to be increased during striking. Additionally, this has the desired effect of increasing the "sweet spot" of the club face 12.

The method of constructing the club head 10 will now be described. The face 12 is pre-cast of the proper alloys, with the pins 32 extending from the rearward face 18 thereof. The backing is separately molded with the cavity 38 formed therein. Receiving recesses (not shown) are also formed in the backing 14, by boring or other known means. These recesses are so formed so that the pins 32 of the face 12 may be received therein and a close fit established between the members 12, 14. The face 12 and the backing 14 are then bonded together by means for joining. In the preferred embodiment, the backing 14 is welded to the face 12. However, other means for joining, such as soldering or other known means, may be elected.

Referring now to FIG. 4, there is shown a second embodiment of the club head 110 of the present invention. The face 112 of the second embodiment of the head 110 is substantially similar to that of the first embodiment. Thus, all discussion concerning the first embodiment will be considered applicable to the second embodiment.

The backing 114 is formed such that the planar member 136 is joined to the ridge 134 at a slightly recessed position. This recessed formation defines a recess 141. When the backing 114 is joined to the face 112, the recess 141 is contained between the planar member 136 and the rearward side of the face 112. The recess 140 is in fluid communication with the cavity 138 formed in the ridge 134. The formation of the recess 140 allows for a different weight distribution to be achieved in the head 110, as desired by the manufacturer. It is envisioned that the inner portion of the ridge 134 may continue to contact the rearward side 118 of the face 114. Thus, it is foreseen that the cavity 138 and the interior 141 will not be in fluid contact.

Referring now to FIG. 5, there is seen a view of a third embodiment of the club head 210 of the present invention. The face 212 is substantially similar to that of the first embodiment. The backing 214 of the third embodiment differs from the previous embodiment in that no planar member comprises a portion of the backing 214. Rather, a trough 235 and a plate 239 comprises the backing 214. This effects both the desired perimeter weighting as well as a reduced club face thickness, as that thickness is not increased by a planar member.

To form the backing 214 of the third embodiment, a trough 235 is molded onto the rearward side of the face 212. The trough 235 comprises an outer ridge 250 and an inner ridge 252 cast onto the rearward side 218 of the face 212. The trough 235 defines a cavity 238 therein. A plate 239, corresponding to the shape of the perimeter of the trough 235, is deployed thereatop. The plate 239 is then welded onto the trough 235, thus effecting the closure of the trough 235. By this, the head 210 is elongated and the weight balance maintained.

It is to be understood that the foregoing description is subject to variations which are obvious to one of ordinary skill in the art. Thus, the foregoing description is not to be seen as limiting to those specific embodiments detailed herein, but rather are to be seen in their broader conception and are meant to include such variation as would occur to one of ordinary skill in the art.

Having, thus, described the present invention, what is claimed is:

1. A perimeter-weighted club head for an iron-type golf club, the head comprising:

(a) a face member having a forward side and a rearward side, the forward side having a rearward angulation, the face member having a perimeter;

(b) a plurality of pins unitarily formed to the rearward side of the face member;

(c) a backing mounted onto the pins and joined to the rearward side of the face, the backing comprising a circumferential ridge having an outer perimeter and an inner perimeter, the outer perimeter being substantially similar to the perimeter of the face, the ridge having a cavity formed between the inner and the outer perimeters; and (d) means for joining the backing to the face.

2. The club head of claim 1, further comprising a planar member, the planar member being disposed proximate the inner perimeter of the backing.

3. The club head of claim 1, wherein the head is formed of a stainless steel alloy.

4. The club head of claim 1, wherein the head is formed of a titanium alloy.

5. The club head of claim 1, further comprising a hosel formed adjacent the face member.

6. A perimeter-weighted club head for an iron-type golf head, the head comprising:

(a) a face member having a forward side and a rearward side, the forward side having a rearward angulation, the face member having a perimeter;

(b) a plurality of pins unitarily formed to the rearward side of the face member;

(c) a backing mounted onto the pins and joined to the rearward side of the face member, the backing comprising:

(1) a circumferential ridge having an outer perimeter and an inner perimeter, the outer perimeter substantially similar in shape to the perimeter of the face member, the ridge having a cavity formed; and (2) a planar member unitarily formed to the ridge proximate the inner perimeter, the planar member being formed thereto such that a recess is formed between the planar member and the rearward side of the face member; and (d) means for joining the backing to the face member.

7. The club head of claim 6, further comprising a hosel unitarily formed to the face member.

8. The club head of claim 6, wherein the recess and the cavity are in fluid communication.

9. The club head of claim 1, wherein the head is formed of a stainless steel alloy.

10. The club head of claim 1, wherein the head is formed of a titanium alloy.

11. A method of forming a club head for a golf club, comprising the steps of:

(a) forming a club face with a plurality of pins unitarily formed to a side thereof;

(b) forming a club backing comprising a ridge having a cavity formed between an inner and an outer perimeter of the ridge;

(c) mounting the backing onto the pins of the face;

(d) welding the backing onto the face.

* * * * *